United States Patent [19]

Stenz

[11] 4,416,500

[45] Nov. 22, 1983

[54] SCREWLESS ELECTRICAL TERMINAL

[75] Inventor: Paul Stenz, Detmold, Fed. Rep. of Germany

[73] Assignee: C. A. Weidmuller GmbH & Co., Detmold, Fed. Rep. of Germany

[21] Appl. No.: 318,904

[22] Filed: Nov. 6, 1981

[30] Foreign Application Priority Data

Nov. 7, 1980 [DE] Fed. Rep. of Germany ..... 3042057

[51] Int. Cl.[3] ..... H01R 9/08

[52] U.S. Cl. ..... 339/95 D; 339/254 R

[58] Field of Search ..... 339/97 R, 95 D, 254 R

[56] References Cited

FOREIGN PATENT DOCUMENTS 1905379 2/1966 Fed. Rep. of Germany ... 339/95 D 41-444826 3/1966 Japan ..... 339/95 D

*Primary Examiner*—Joseph H. McGlynn

*Assistant Examiner*—Paula Austin

*Attorney, Agent, or Firm*—Pollock, Vande Sande & Priddy

[57] ABSTRACT

A screwless electrical terminal comprises a connector bar and a clamping cage embracing the bar and biassed by a spring to clamp a conductor between the bar and the cage bottom. The cage can be latched open for example by teeth on the rear of the cage engaging recesses on the connector bar, to allow insertion of a conductor. The cage has a forwardly and downwardly projecting pivot element which engages a fixed abutment if traction on the conductor causes the cage to move along the connector bar. Such movement brings the pivot element into engagement with its abutment and thereafter causes the cage to tilt so as to increase the conductor-clamping force in response to traction on the conductor.

16 Claims, 4 Drawing Figures

SCREWLESS ELECTRICAL TERMINAL

This invention relates to screwless electrical terminals, in particular for connecting conductors to connector bars.

German Patent Specification AS No. 1905379 describes a screwless terminal comprising a connector bar embraced by a cage-like clamping member spring-biassed to clamp a conductor between the underside of the connector bar and the bottom of the cage. The clamping member can move bodily and also tilt relative to the connector bar and can be latched under a fixed stop, in a tilted position, thereby holding the clamping member in an open position such that a conductor can easily be inserted between the connector bar and the bottom of the cage-like clamping member. The clamping member is then released from the latching stop so as to clamp the inserted conductor under spring bias. Such a terminal is of simple construction, easy to assemble, and quick and easy to use. It can be set in the open position at the factory, so that the user only has to insert a conductor into the open terminal and release the clamping member from the latching stop, whereupon the clamping member is urged by its spring to a clamping position for retaining the conductor. The connecting operation can be carried out with one hand, and furthermore is well suited to automation of the connecting operation. However, the clamping member is kept in its clamping position only by a spring, and the strength of the spring is limited by the stregth of the materials used for the clamping member (usually sheet metal), the connector bar, and the insulating casing usually provided and constituting the latching stop. Furthermore the spring must not be so strong that it cannot be easily released, for example using a screw driver or other tool. Because of these limits on the strength of the clamping spring, and the fact that the clamping member can move bodily and tilt, the inserted conductor may not be retained sufficiently firmly or reliably, particularly against tension.

An object of the present invention is to provide a screwless electrical terminal with the easy operation mentioned above, but capable of reliably retaining a conductor even against traction on the conductor.

According to one aspect of the present invention there is provided a screwless terminal, in particular for connecting a conductor to a bus bar, comprising a shiftable and tiltable terminal cage which is under spring pressure and, when the terminal is in its open position, is releasably locked in a tilted position against a fixed stop, characterised in that a tilting pivot is formed on the terminal cage on the side thereof corresponding to the cable withdrawal direction, and in its path of travel in the cable withdrawal direction there is provided a fixed abutment.

According to another aspect of the invention there is provided a screwless electrical terminal comprising first and second clamping members for clamping between then an electrical conductor, said first member being a cage-like member movable bodily and tiltable relative to the said second member, clamping means resiliently biasing the first member to a conductor-clamping position, and a latching stop adapted to releasably retain the first clamping member in an open position for reception of a conductor between the clamping members, said clamping members having a predetermined conductor-insertion direction, said first clamping member having a pivot element on that side of the first clamping member at which a conductor is inserted, and said terminal further including an abutment facing the said pivot element for engagement thereby on movement of the first clamping member in the direction opposite the conductor-insertion direction, the abutment and pivot element being so disposed that such movement of the first clamping member tends to pivot the first clamping member to increase the conductor-clamping force exerted by the first clamping member.

The result of the arrangement according to the present invention is that tilting of the first clamping member about the said pivot element and abutment will tend to increase the force with which a conductor is clamped. The arrangement is such that if traction is exerted on the conductor, it will tend to bring the pivot element into engagement with the abutment and thereafter to tilt the clamping member, thereby increasing the force with which the conductor is clamped, in proportion to the traction exerted on the conductor.

More specifically, if a pull is exerted on the inserted conductor in its withdrawal direction, the cage-like clamping member together with the conductor firstly make a small movement on the bar or other fixed part to be connected, because a certain play on the one hand cannot be prevented because of manufacturing tolerances, and on the other hand is necessary for allowing the terminal to be latched in its open position by virtue of the shiftability and tiltability of the clamping member. However, the tilting pivot element immediately meets the fixed abutment, after a very short path of travel, with the result that if the pull on the conductor increases, the fact that the pivot element bears on the abutment to form a fulcrum means that the clamping member tilts relative to the conductor and to the connector bar or other connector part, leading to an increasingly firmer pressing together of the clamping member, conductor and bar, the stronger the pull on the conductor. Any unintended withdrawal of the conductor from the closed terminal is thus made impossible.

A particularly stable and simple construction is attained if the tilting pivot element is formed by the free end edge of a lever which is provided on the clamping cage so that it projects beyond its longitudinal extension and outwards from it laterally. The abutment is then satisfactorily and simply formed by a surface portion of an adjacent terminal casing inner wall provided with grooving. In the case of a pull on the conductor in the withdrawal direction, the free end of the lever is immediately halted in one of the grooves of its abutment, and the required tilting movement of the terminal cage is ensured, this blocking any further withdrawal of the conductor.

The accompanying drawings show, by way of example only, two embodiments of the invention. In the drawings:

FIGS. 1 to 3 show a screwless terminal for connecting a conductor 1 to a connector bar 2 or to another suitable current-carrying member, according to the intended use of the terminal in question.

The components of the terminal are housed within an insulating casing of any suitable form, parts of which are indicated at 11 and 12. The conductor bar may for example extend into a second mirror-image terminal for connection of a second conductor, within an insulating casing provided with a locating foot adapted to be mounted on a flanged supporting rail of standard cross section, in well known manner. Alternatively, the illustrated terminal may be incorporated in a switch or other electrical circuit component or in an electrical appliance.

Figure 1:
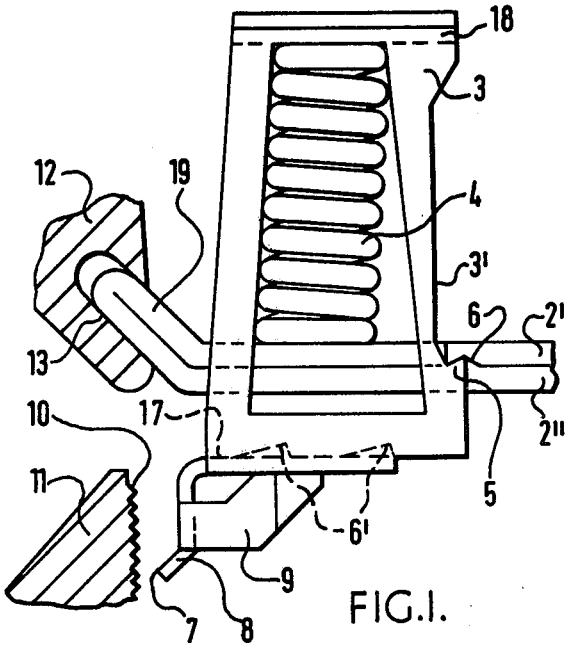
FIG. 1 is a side view of a screwless terminal with an adjacent casing inner wall portion.
Figure 2:
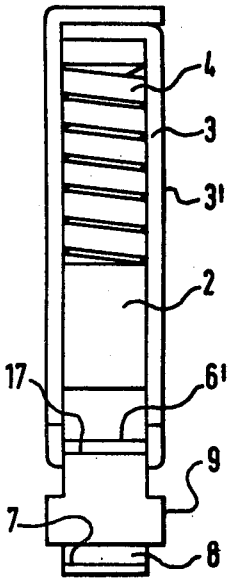
FIG. 2 is an end view of the terminal of FIG. 1.
Figure 3:
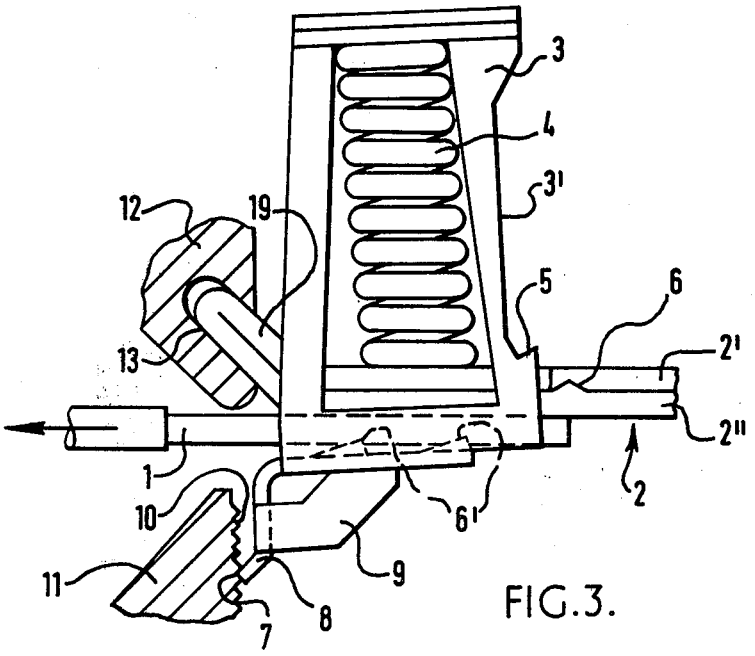
FIG. 3 is a view of the terminal of FIG. 1 in its closed position with the conductor inserted and a pull being exerted on the conductor in its withdrawal direction.

The terminal shown in FIGS. 1 to 3 has a clamping member in the form of a generally rectangular cage 3 of bent sheet metal, through which the bar 2 extends. In use, the conductor 1 is clamped between the underside of the connector bar, and the floor 17 of the clamping member or cage 3, by a compression spring 4 inside the cage, one end of the spring pressing against the upper side of the connector bar, and the other end of the spring pressing against the interior of the top wall 18 of the cage.

It will be seen that the cage 3 can move bodily relative to the conductor bar in its longitudinal direction, against the force of the spring, and can also tilt relative to the connector bar within limits.

To enable a conductor to be inserted, the terminal cage 3 can be latched in an open position in which its floor 17 is spaced from the connector bar 2, as shown in FIG. 1. As can be seen from the drawings, the conductor is inserted from one side of the cage 3. At the opposite side of the cage, each of its side limbs 3' which embrace the connector bar is provided with a rearwardly and upwardly extending tooth or hook 5, which can be brought into engagement with a corresponding downwardly facing recess 6 provided in the connector bar. Thus the connector bar acts as a latching stop for latching the cage in its open position. The spring will hold the cage in the open position, by pressing the teeth or hooks 5 into the latching recesses 6.

In the illustrated embodiment, the bar 2 consists of two layers of metal, giving it high rigidity. In the region of the side limibs 3' of the terminal cage, that is to say, in the region remote from the side at which the conductor is inserted, the upper layer 2' of the connector bar projects laterally beyond the lower layer 2'' of the connector bar, on both sides of the bar, and the recesses 6 are formed in these projecting regions of the upper layer.

The terminal cage 3 is moved into its latched open position by downward pressure on its top wall 18, causing the teeth or hooks 5 to slip under the projecting portions of the upper connector bar layer 2' and into the recesses 6, against the pressure of the spring 4, together with a slight tilting of the cage leading to a tilt of the spring, or of the spring and the cage, when in the latched open position.

To connect a conductor, the latter is inserted between the floor 17 of the cage and the connector bar 2, and the top 18 of the terminal cage is pressed down whereupon the teeth or hooks 5 are released from the recesses 6 and the cage will virtually automatically tilt to move the teeth or hooks clear of the projecting portions of the upper connector bar layer, as the spring will naturally tend to return from its tilted position shown in FIG. 1 to a straight position. When the pressure on the top of the terminal cage is released, the spring will urge the cage upwards to clamp the conductor as shown in FIG. 3.

In alternative constructions, the movable cage 3 can be latched against other adjacent stationary parts, for example against a shoulder on an internal wall of the insulating casing.

To retain the conductor, the floor 17 of the cage 3 has upwardly projecting prismatic teeth 6' of saw-toothed profile, which can bite into the conductor. For the same reason, the underside of the bar 2 may be roughened or serrated. However, as already explained, the fact that the terminal cage can move bodily and can tilt relative to the connector bar, together with the limits inevitably imposed on the strength of the spring 4, strong traction on the conductor can loosen or even withdrawn the conductor. Such traction can cause the terminal cage to move along the connector bar.

To prevent the conductor from being pulled out of the terminal, means are provided for increasing the conductor-clamping force exerted by the terminal in response to traction on the conductor. These comprise a pivot element 7 on the button of the terminal cage 3, and a cooperating abutment 11 providing a fulcrum about which the terminal cage can pivot upwards on its pivot element 7, if the cage is caused to move in the direction of withdrawal of the conductor.

In the illustrated embodiment the pivot element 7 is the free end of a lever 8 integral with the floor of the cage 3. The lever projects downward below the cage floor 17 and forwards in the longitudinal direction of the connector bar, in the direction of the withdrawal of the conductor and at that side of the cage 3 at which the conductor is inserted. To stiffen the lever 8, it is provided with side plates 9 bracing it against the floor 17 of the cage 3. Such stiffening is necessary because the lever 8 can be subjected to substantial forces if traction is exerted on the conductor 1.

The fixed abutment 11 is a part of the insulating casing of the terminal. The internal surface of this part, facing and adjacent to the tip of the leaf 8, has grooves 10 parallel to the edge of the lever tip. If traction is exerted on the conductor as shown in FIG. 3, the engagement of the cage floor 17 with the conductor will tend to move the cage along the connector bar in the direction of the traction tending to withdraw the conductor. As can be seen from FIGS. 1 and 3, only a very short movement of the conductor and cage will bring the tip 7 of the lever 8 into engagement with a groove 10 of the abutment 11. The lever is thus positively located by the groove and any further movement of the conductor will cause no further movement of the cage 3 along the connector bar, but will tend to cause the cage to pivot anti-clockwise (as seen in FIG. 3) about the fulcrum formed by the tip of the lever 8 and the abutment 11. Such pivoting movement of the cage increases the clamping force exerted by the cage floor 17 against the conductor, and the resulting increased conductor-clamping force will rise as the traction on the conductor rises.

The teeth 6' are shaped as already described, to ensure good engagement between the conductor and the floor 17 in relation to longitudinal movement of the conductor. They may additionally be grooved or serrated further to improve their engagement with the conductor 1.

The connector bar 2 is subjected to substantial forces, both in normal use, and due to the increased clamping force arising from traction on the conductor. The double-layer structure of this bar provides adequate strength. To locate the bar firmly, its end 19 is angled upwards and is accommodated in a slot or recess 13 in the terminal casing 12 or another adjacent fixed member. The slot or recess is inclined and relatively long to provide a long reliable guide for the bar end. Preferably, the connector bar is mounted in the described manner at both ends. The described mounting provides strong and reliable retention of the bar, capable of absorbing without difficulty the forces arising from traction on the conductor. Because of the angled arrangement of the bar ends and receiving slots, such additional forces will tend to act in the longitudinal direction of the slot. In normal use, that is to say when there is no substantial traction on the conductor, the clamping forces do not act on the terminal casing, when the terminal is either open or clamping a conductor. Instead, the clamping forces are absorbed entirely within the system consisting of the terminal cage, spring, connector bar, and conductor if present.

Figure 4:
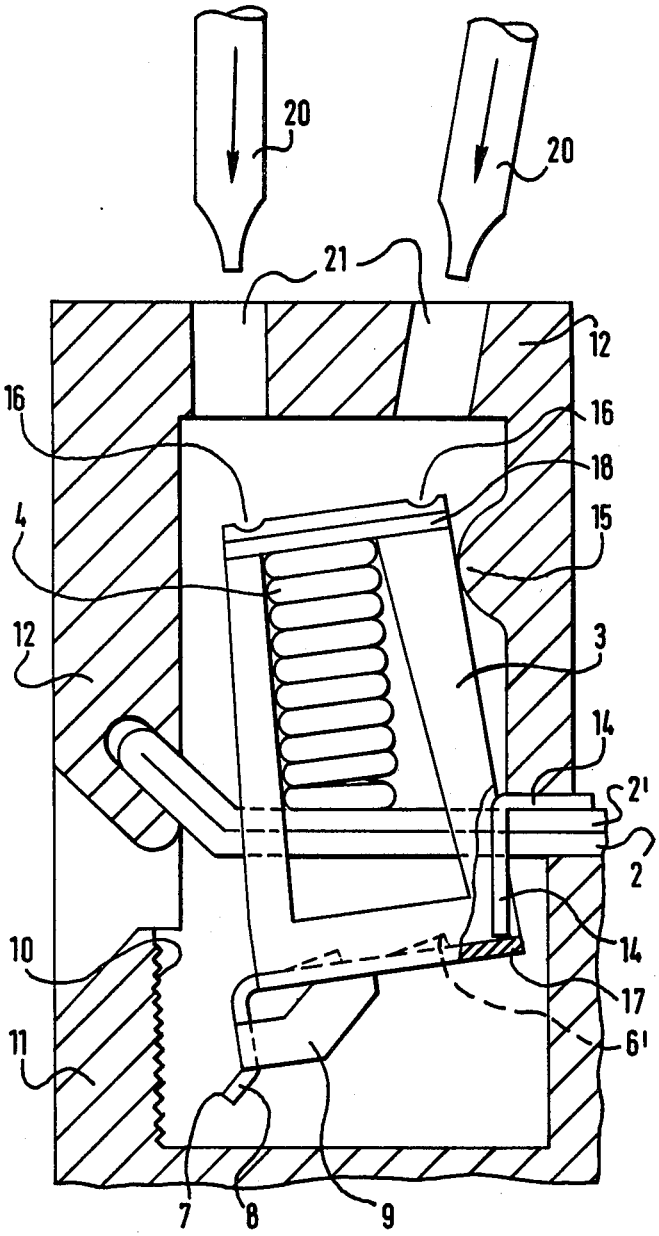
FIG. 4 shows a further terminal in its open position.

FIG. 4 shows a second form of terminal embodying the invention, which is generally similar to that shown in FIGS. 1 to 3. The main difference is that the teeth or hooks 5, and corresponding recesses 6, are omitted. FIG. 4 also shows features enabling the terminal to be operated by a screw driver or other tool 20. The terminal casing 12 has in its upper region, above the cage 3, openings 21 through which the tool 20 can be inserted. The top wall 18 of the cage has recesses 16, one at each end and aligned with the openings 21. These recesses are to ensure reliable engagement of the tool on the terminal cage 3. To move the terminal cage to its open position, the tool is pressed into the left hand recess 16 (in FIG. 4) that is to say the recess at the conductor-insertion side of the cage. This forces the cage downwards and tilts it so that the cage floor 17 engages a latching stop 14 which in this position, projects into the cage. To clamp an inserted conductor, the tool is pressed into the other recess 16, at the rear of the terminal cage, causing the cage to move slightly downwards and tilt clear of the latching stop, so that the spring 4 can raise the cage to clamp the inserted conductor against the bar 2. The terminal casing 12 has, on an internal surface, a projecting guide contour 15 adjacent to the rear of the terminal cage, that is to say the side of the cage remote from the conductor-insertion side. This guide contour favours the movement of the cage into the required inclined position, when the cage is moved into its latched open position.

The embodiment shown in FIG. 4 also provides for automatic clamping of an inserted conductor without the use of a tool. This is achieved by the use of a latching element 14 of which at least the part that engages the cage floor 17 is movable in the conductor-insertion direction, this part being disposed in the path of the inserted conductor. In consequnce, when the conductor is pushed into the open terminal, its tip will push the latching stop 14 clear of the cage bottom 17, whereupon the cage will snap into its conductor-clamping position under the action of the spring 4. In the illustrated embodiment the latching stop 14 is an L-shaped spring, for example a leaf spring, of which one limb extends downwards below the connector bar, to form a resiliently flexible latching stop capable of being released by the inserted conductor end. Because, in the open position, the cage is tilted as shown in FIG. 4, when the cage is released from the latching stop 14 it not only rises towards the connector bar but also automatically tilts clockwise due to the off-centre thrust exerted by the movably seated spring.

The latching stop can be formed as a spring clip which can be fixed simply in position for example by providing its downwardly projecting region, in the region of its angle, with a rectangular recess which matches and fits round the cross section of the connector bar, by means of which the spring clip can be slid onto the bar.

I claim:

1. A screwless electrical terminal comprising first and second clamping members for clamping between them an electrical conductor, said first member being a cage-like member movable bodily and tiltable relative to the said second member, clamping means resiliently biasing the first member to a conductor-clamping position, and a latching stop adapted to releasably retain the first clamping member in an open position for reception of a conductor between the clamping members, said clamping members having a predetermined conductor-insertion direction, said first clamping member having a pivot element on that side of the first clamping member at which a conductor is inserted, and said terminal further including an abutment facing the said pivot element for engagement thereby on movement of the first clamping member in the direction opposite the conductor-insertion direction, the abutment and pivot element being so disposed that such movement of the first clamping member tends to pivot the first clamping member to increase the conductor-clamping force exerted by the first clamping member.

2. A terminal as claimed in claim 1, characterised in that the pivot element is formed by the free end edge of a lever which is provided on the cage-like first clamping member so that it projects beyond its longitudinal extension and outwards from it laterally.

3. A terminal according to claim 2 further including stiffening side plates provided on the said lever.

4. A terminal according to claim 1, 2 or 3 having a terminal casing with an internal wall surface facing the said pivot element and forming the said abutment, which surface is provided with grooves for locating the said pivot element.

5. A terminal according to claim 1 in which the cage-like first clamping member has a floor region facing and immediately adjacent to the second clamping member, for receiving a conductor between the said floor region and second clamping member, the said floor region being provided with at least one tooth projecting towards the second clamping member.

6. A terminal according to claim 5 in which the or each said tooth is of prismatic form and provided with grooves for engaging an inserted conductor.

7. A terminal according to any of claims 1 to 3 including a terminal casing, and in which the second clamping member is a bar extending through the cage-like first clamping member which bar has angled ends, the said casing having corresponding inclined recesses which receive the angled ends of the said bar.

8. A terminal according to claim 1, in which the second clamping member is a bar extending through the cage-like first clamping member which bar comprises two layers of which one layer projects laterally beyond the other layer in a region remote from the conductor-insertion side of the first clamping member, the projecting portion of the said one layer being provided with latching recesses for engagement by the first clamping member and thereby constituting the said latching stop.

9. A terminal according to claim 8 in which the first clamping member has, on the side thereof remote from the conductor-insertion side, latching projections for engaging the said latching recesses, a respective latching projection and recess being provided at each side of the said bar and first clamping member.

10. A terminal as claimed in claim 1 in which the said latching stop is a fixed member arranged to project into the interior cage-like first clamping member and disposed in the path of an inserted conductor.

11. A terminal as claimed in claim 10 in which the latching stop is a spring clip mounted on the second clamping member.

12. A terminal as claimed in any of claims 1 to 3 including a terminal housing provided with an internal surface adjacent to that side of the first clamping member remote from the conductor-insertion side thereof and shaped to guide the first clamping member into the said open position, the first clamping member being tilted relative to the second clamping member when in the said open position and latched by the latching stop.

13. A terminal as claimed in any of claims 1 to 3 in which the pivot element is at a first end of the first clamping member, and the first clamping member has at an opposite end, relative to the clamping direction, recesses for locating a tool to move the first clamping member between its open position and its conductor-clamping position.

14. A terminal as claimed in any of claims 1 to 3 when disposed inside an electrical circuit component.

15. A terminal as claimed in any of claims 1 to 3 when disposed in a rail-mountable electrical terminal unit.

16. A screwless terminal, in particular for connecting a conductor to a bus bar, comprising a shiftable and tiltable terminal cage which is under spring pressure and, when the terminal is in its open position, is releasably locked in a tilted position against a fixed stop, characterised in that a tilting pivot is formed on the terminal cage on the side thereof corresponding to the cable withdrawal direction, and in its path of travel in the cable withdrawal direction there is provided a fixed abutment.

* * * * *